US011278108B2

(12) United States Patent
Cavalcanti

(10) Patent No.: US 11,278,108 B2
(45) **Date of Patent: *Mar. 22, 2022**

(54) CLEANING BRUSH WITH DETACHABLE HANDLE

(71) Applicant: Butler Home Products, LLC, Hudson, MA (US)

(72) Inventor: Robert Cavalcanti, Marlborough, MA (US)

( * ) Notice: Subject to any disclaimer, the term of this patent is extended or adjusted under 35 U.S.C. 154(b) by 21 days.

This patent is subject to a terminal disclaimer.

(21) Appl. No.: 16/995,051

(22) Filed: Aug. 17, 2020

(65) Prior Publication Data

US 2020/0375345 A1 Dec. 3, 2020

Related U.S. Application Data

(63) Continuation of application No. 15/852,061, filed on Dec. 22, 2017, now Pat. No. 10,743,644.

(51) Int. Cl.
*A46B 5/00* (2006.01)

(52) U.S. Cl.
CPC ..... *A46B 5/0095* (2013.01); *A46B 5/0029* (2013.01); *A46B 2200/304* (2013.01); *A46B 2200/3033* (2013.01)

(58) Field of Classification Search
CPC ... A46B 5/0095; A46B 5/0029; A46B 5/0025; A46B 2200/3033; A46B 2200/304
See application file for complete search history.

(56) References Cited

U.S. PATENT DOCUMENTS 6,152,635 A 11/2000 Wu

*Primary Examiner* — Andrew A Horton
(74) *Attorney, Agent, or Firm* — McCarter & English, LLP

(57) ABSTRACT

A cleaning brush comprises a removable handle and a brush. The removable handle includes a connector portion having a backing plate with means for connecting the handle to a brush, and means for releasing the handle to detach the handle from the brush. The brush includes a brush plate having means configured to receive the means for connecting and detaching the handle from the brush plate. The brush plate has a rigid portion and a flexible portion. The flexible portion may include segments defined by channels in the flexible portion.

4 Claims, 6 Drawing Sheets

CLEANING BRUSH WITH DETACHABLE HANDLE

The present application claims priority under 35 U.S.C. § 120 to U.S. patent application Ser. No. 15/852,061 filed on Dec. 22, 2017, the entire contents of which are hereby incorporated by reference.

FIELD OF THE INVENTION

The present invention relates, in one aspect, to a brush for household cleaning, such as for example cleaning a bathtub, a sink, a countertop or a floor. The cleaning brush has a detachable handle to allow the brush portion to be gripped by hand for cleaning corners or other areas that may be difficult to clean effectively with the handle attached to the brush. To further allow cleaning of corners or other hard-to-reach areas, at least a portion of the base of the brush may be made from a flexible material to allow the brush portion to conform to the shape of the surface being cleaned. The flexible portion of the base of the brush may comprise a series of channels in the base to further allow the brush to flex and conform to the surface being cleaned.

BACKGROUND OF THE INVENTION

Traditionally, cleaning brushes for household scrubbing come in two varieties: a unitary brush with bristles attached to a brush plate, where the brush plate further functions as a handle for gripping the brush, or brushes with a handle protruding from a brush plate, where the protruding handle provides additional leverage and comfort to the user of the brush. However, neither of these two varieties of cleaning brush are ideal in all situations. A user of a brush with a protruding handle may find that a handle can obstruct cleaning of tight areas whereas the brush without a handle could easily fit in those spaces. Similarly, a protruding handle may force the user to grip the handle in an uncomfortable manner when scrubbing in certain positions (such as a wall above the user's head).

Attaching a handle to a brush in a removable way introduces various design difficulties. The brush and handle should be simple to attach and detach, without overly complex fasteners or mechanisms. Conversely, a handle should be attached in a sturdy and rigid manner. A cleaning brush with a handle can impart a considerable manual force on the handle when using the brush for cleaning a surface and ideally, any method of attaching the brush must be able to withstand such an operating force. Accordingly, it is an object of the present invention to have brush with a detachable handle that is simple to use and provides a sturdy handle when attached to the brush.

SUMMARY OF THE INVENTION

The present disclosure is directed generally to a cleaning brush having a detachable handle.

In one embodiment, the cleaning brush comprises a detachable handle and a brush that may be used for cleaning. The handle comprises a gripping portion and a connector portion. The connector portion includes a backing plate with a plurality of connector pins. The handle further comprises a release mechanism. The release mechanism comprises a release pin aligned in a release pin slot in the handle, a biasing member aligned coaxially with the release pin along the release pin slot, and a release actuator comprising a button having sloped surface aligned in a channel substantially perpendicular to the release pin slot, the sloped surface in engagement with the release pin. The brush comprises a brush plate having a plurality of receptacles configured to receive the plurality of connector pins on the handle.

The connector pins may comprise a post with a protrusion at the end of the post.

The release pin may comprise a post with one or more protrusions in engagement with the sloped surface, wherein pressing the release actuator causes the sloped surface to retract the release pin into the handle. The retraction of the release pin frees the handle to release from the brush.

Insertion of the handle into the brush causes the release pin to retract into the release pin slot and the biasing member causes the release pin to extend into the first receptacle when the handle is engaged with the brush.

In one embodiment, the biasing member is a coil spring.

In one embodiment, the one or more protrusions on the release pin comprise two substantially parallel protrusions extending radially from the release pin.

The sloped surface may comprise two substantially parallel sloped rails. The slope angle of the two substantially parallel sloped rails may be chosen such that pressing the release actuator causes the release pin to retract to a clearance position.

In one embodiment, the brush portion comprises a brush plate having a rigid portion and a flexible portion with bristles attached to both the rigid portion and bristles attached to the flexible portion. The rigid portion may be a solid member and the flexible member comprises segments defined by channels in the flexible member.

In one embodiment, the rigid portion is constructed from a rigid plastic and the flexible portion is constructed from rubber.

The cleaning brush of the present invention may be used with the handle attached to the brush portion, or the handle may be removed to allow the user to clean in spaces where the handle may interfere. The brush includes a flexible portion to allow a user to clean in corners or other areas that may be difficult to clean with a rigid brush. Other objects and advantages of the present invention will become apparent to one skilled in the art in view of the Description of the Invention provided below.

DESCRIPTION OF THE INVENTION

Figure 1:
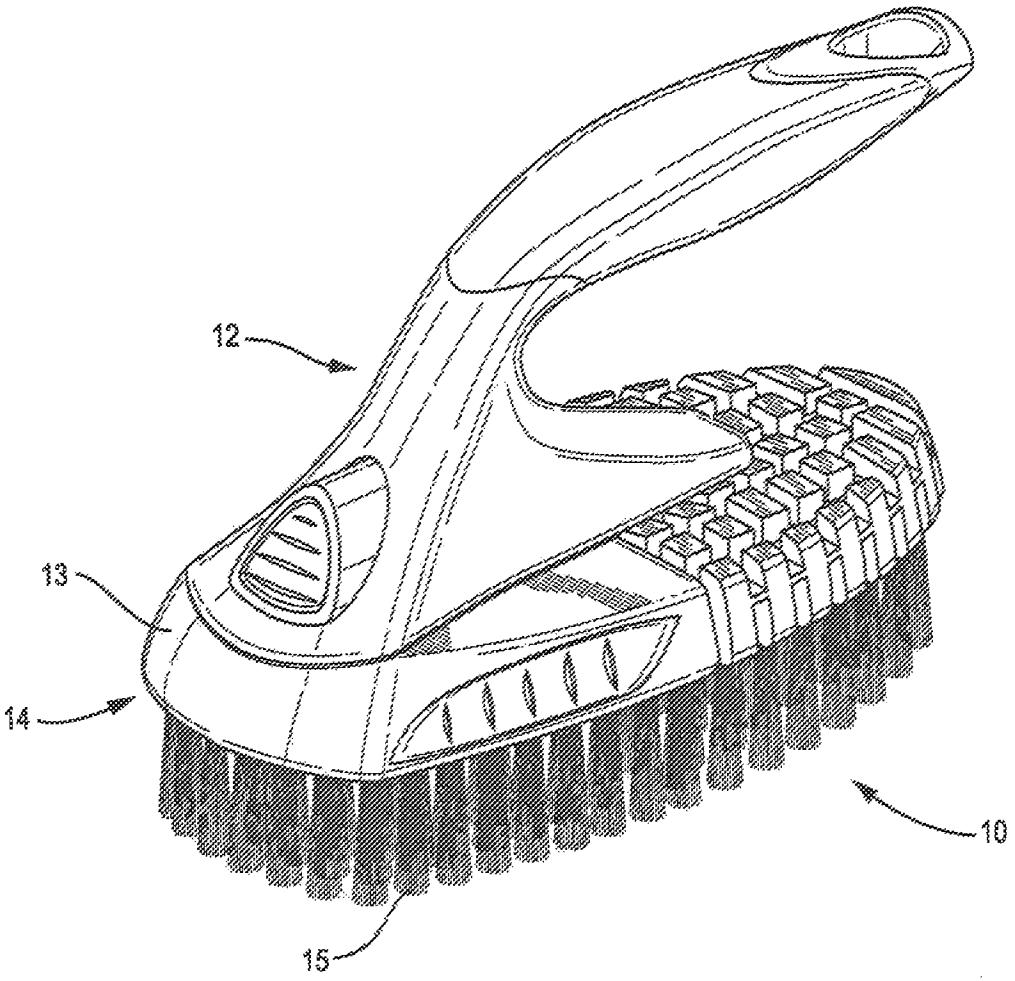
FIG. 1 shows a perspective view of one embodiment of the cleaning brush with the detachable handle attached.

FIG. 1 shows a perspective view of one embodiment of the cleaning brush of the present disclosure. The cleaning brush 10 is comprised of a detachable handle 12 and a brush portion 14. The brush portion 14 comprises brush plate 13 and bristles 15. The detachable handle 12 is removably attached to the brush plate 13 as described in more detail below.

Figure 2:
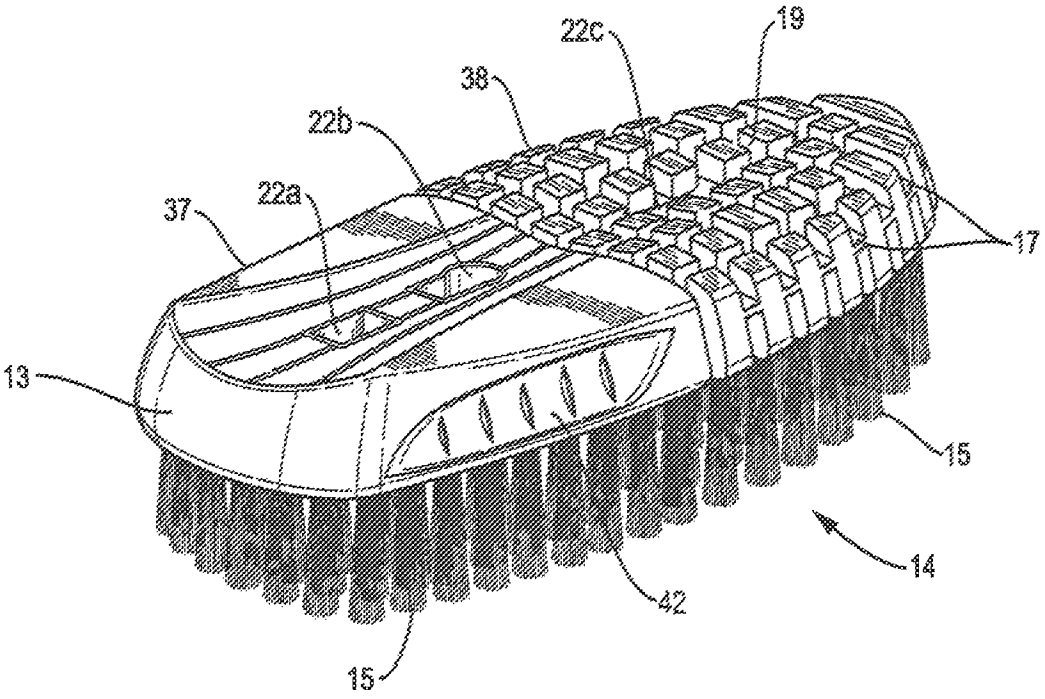
FIG. 2 shows a perspective view of the brush portion of the cleaning brush shown in FIG. 1.

FIG. 2 shows a perspective view of one embodiment of the brush portion of the cleaning brush of the present disclosure. The brush portion 14 comprises a brush plate 13 having a rigid portion 37 and a flexible portion 38, each attached to a corresponding portion of bristles 15. The rigid portion 37 and the flexible portion 38 may be connected by any attaching method, such as a slot connector, adhesive or a weld, or may be a unitary construction. The rigid portion 37 and the flexible portion 38 may be made of any appropriate material. In one embodiment, the rigid portion 37 is made of a rigid plastic or any other rigid material and the flexible portion 38 is made of rubber or any other flexible material. In further embodiments, the shape and dimensions of the rigid portion 37 and flexible portion 38 are chosen to improve rigidity or flexibility respectively. For example, the rigid portion 37 may be chosen as a solid structure, while the flexible portion 38 may be segmented to provide additional flexibility.

As shown, for example, in FIG. 2, in one embodiment, the flexible portion may be shaped as a waffle-like structure of connected segments of flexible material each attached to one or more clusters of bristles. The segments are defined by channels 17, which may extend partly or fully across the flexible portion. The channels may be sized to allow the segments of the flexible portion to flex or bend to a desired degree based on the size and positions of the channels and the flexibility of the material used. Additional channels 19 may be provided substantially perpendicularly to channels 17 to provide further flexibility.

The brush portion 14 may further comprise gripping pads 42 on opposing sides of the brush portion for gripping the brush with the user's hand. The gripping pads 42 may be made of rubber or any other material that will aid in holding the brush plate. Alternatively, the gripping pad 42 may be a recessed portion of the rigid portion 37 comprising ridges for gripping. The brush plate further comprises receptacles 22*a*, 22*b*, and 22*c* fitted to receive corresponding connector pins on the detachable handle as will be further described below with reference to FIGS. 3 and 7.

It should be understood that the brush portion may be of a unitary structure and be either entirely a rigid brush plate or entirely a flexible brush plate. Where the brush plate comprises a rigid portion and a flexible portion, the proportion of the brush plate that is rigid or flexible may be selected as desired.

Figure 3:
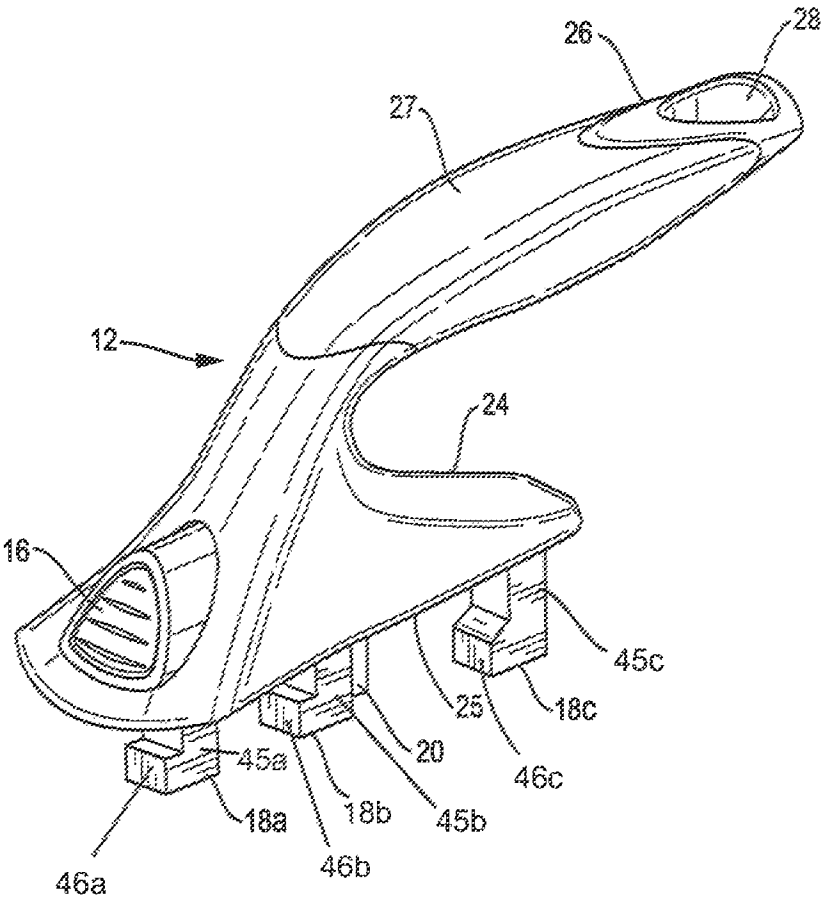
FIG. 3 shows a perspective view of the handle portion of the cleaning brush shown in FIG. 1.

FIG. 3 shows a perspective view of one embodiment of the detachable handle 12 of the cleaning brush of the present disclosure. The detachable handle 12 of the cleaning brush is comprised of a gripping portion 26 and a connector portion 24. One or more connector pins 18*a*, 18*b*, and 18*c* protrude substantially perpendicularly from a backing plate 25 of the connector portion 24. The connector pins 18*a*, 18*b* and 18*c* correspond to the receptacles 22*a*, 22*b* and 22*c* respectively in brush plate 14. The detachable handle 12 further comprises release pin 20, which is engaged by the release actuator 16, such that movement of the release actuator into the detachable handle causes the release pin 20 to retract into the detachable handle 12. The mechanism of the connector pins and release pin are further described below with reference to FIG. 7.

The detachable handle 12 may be made of any appropriate material. In one embodiment, the detachable handle is made of a plastic. A grip 27 for holding the detachable handle may be provided on the gripping portion 26 of the detachable handle. The grip 27 may be made of rubber or any other material that will aid in holding the detachable handle. The detachable handle may further comprise a hanger 28 for storing the brush.

In certain embodiments, the brush portion 14 may be used without the handle 12. In further embodiments, the shape and contours of the handle 12 and brush plate 13 are chosen to ergonomically reduce fatigue or increase the leverage applied by the user of the brush when cleaning dirt or debris from a surface. For use with a handle, the detachable handle 12 may be inserted in the brush 14 with connector pins facing downward. As desired, the handle 12 may be detached and removed from the brush 14 by engaging the release actuator 16. The mechanism of release actuator 16 is further described below with reference to FIG. 7.

Figure 4:
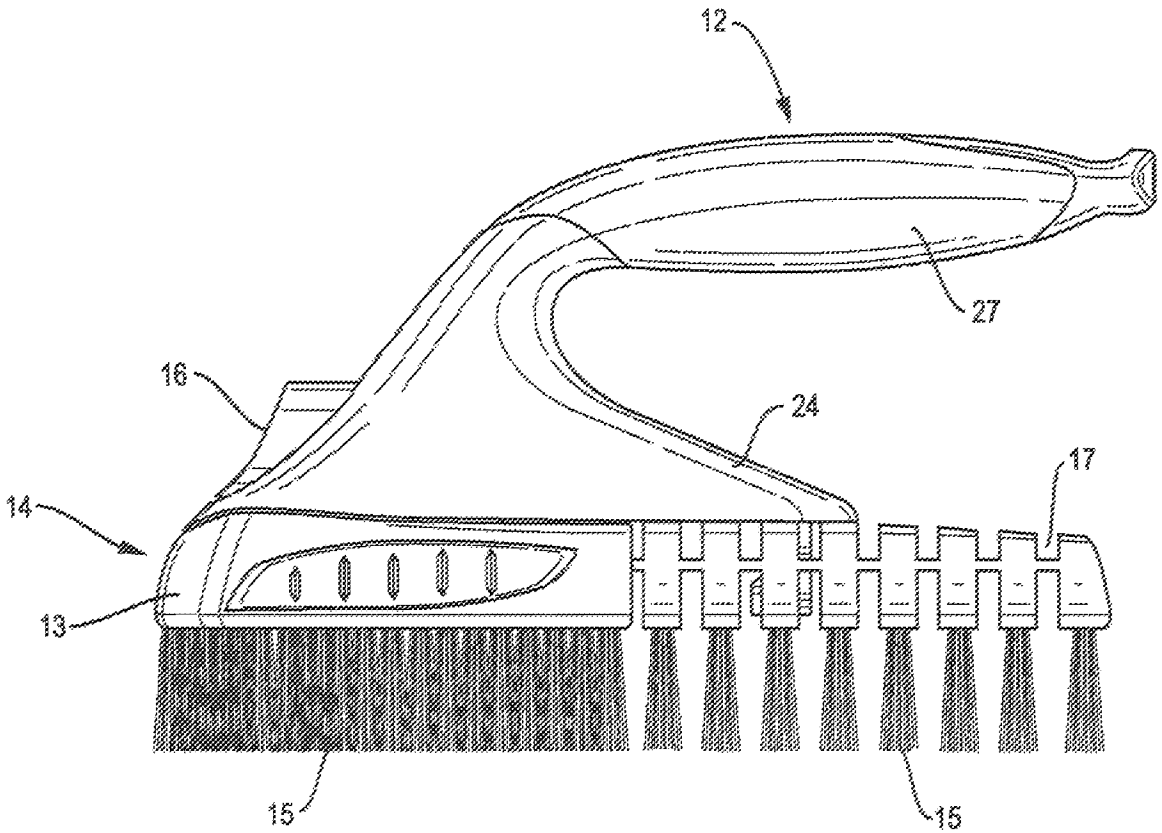
FIG. 4 shows a side view of the embodiment of the cleaning brush shown in FIG. 1.
Figure 6:
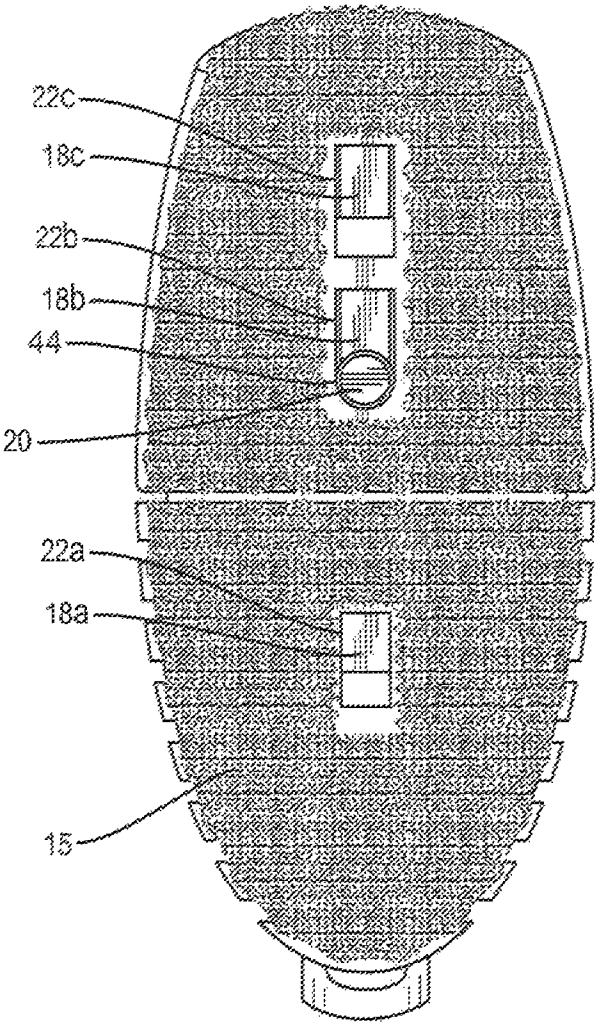
FIG. 6 shows a bottom view of the embodiment of the cleaning brush shown in FIG. 1.
Figure 5:
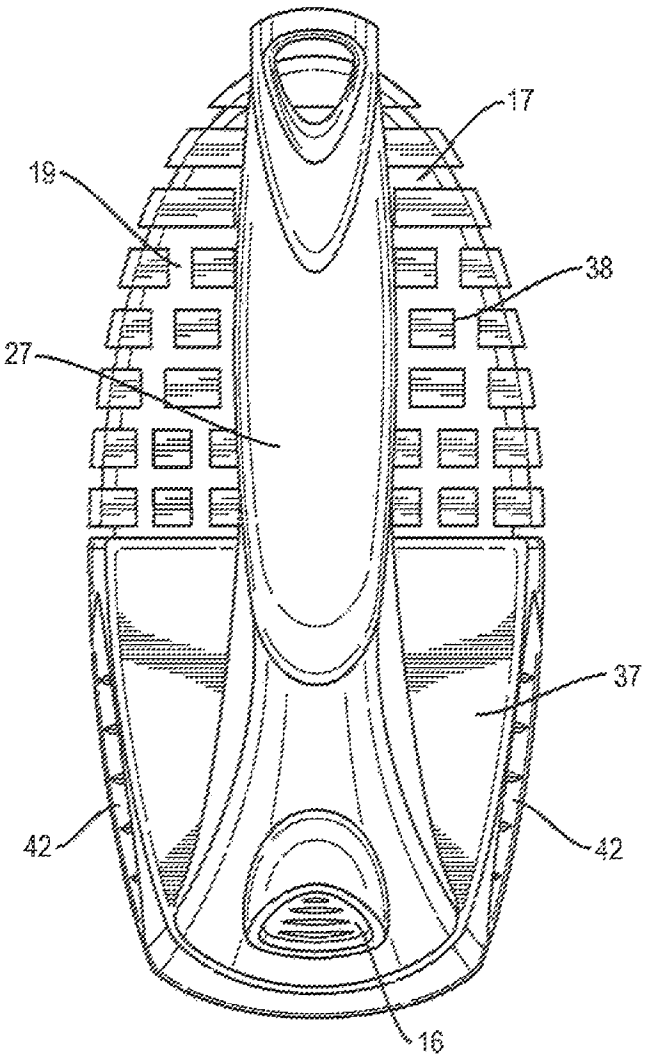
FIG. 5 shows a top view of the embodiment of the cleaning brush shown in FIG. 1.

FIGS. 4 and 5 show a side view and top view, respectively, of one embodiment of the cleaning brush, as described with reference to FIG. 1 above. FIG. 6 shows a bottom view of one embodiment of the cleaning brush, as described with reference to FIG. 1, above. The bottom view of the cleaning brush 10 shows connector pins 18*a*, 18*b*, and 18*c* and release pin 20 of the detachable handle in engagement with receptacles 22*a*, 22*b*, and 22*c* of the brush plate. The mechanism of connection and release of the handle to the brush plate is further described below with reference to FIG. 7.

Figure 7:
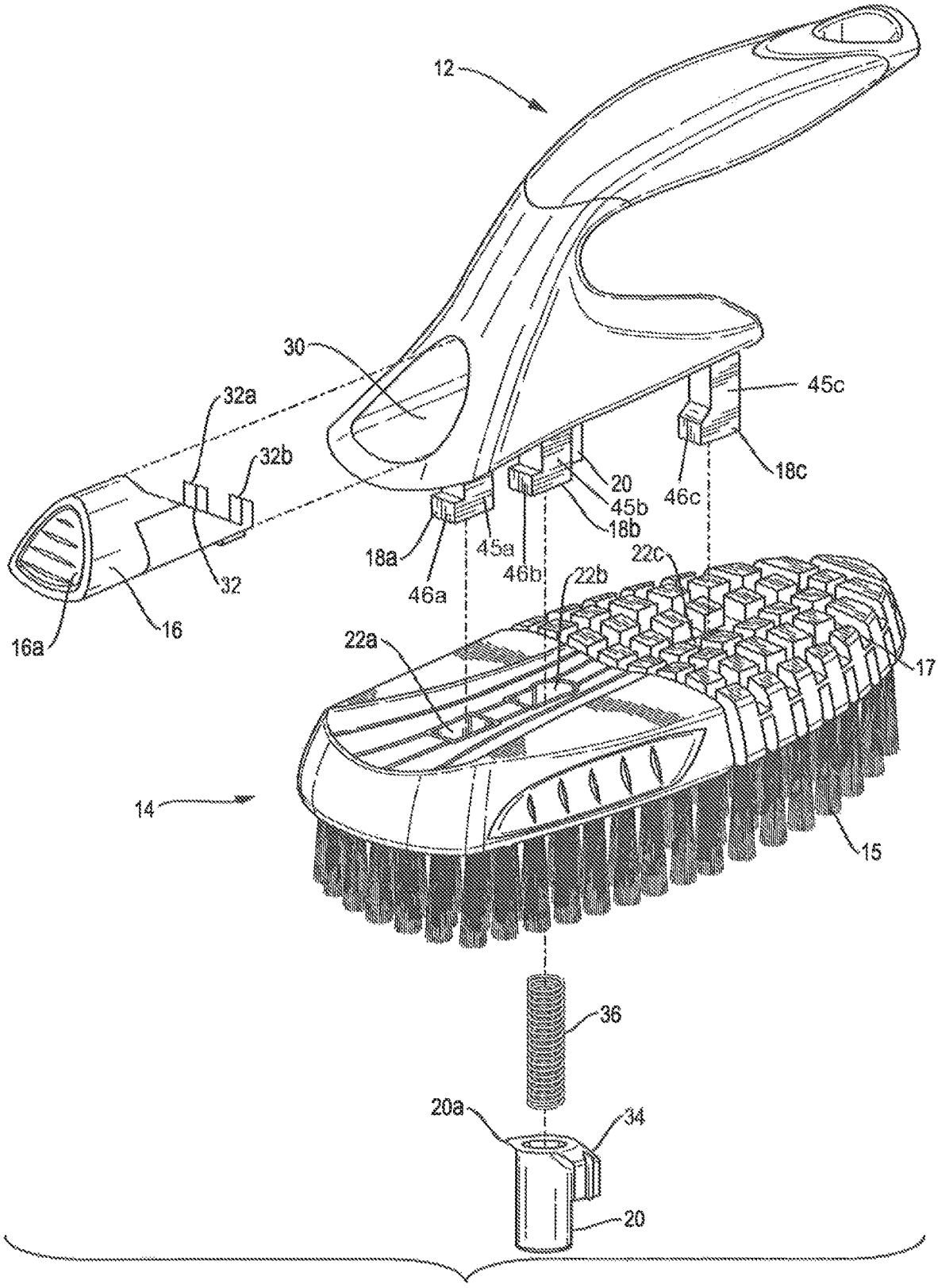
FIG. 7 shows an exploded view of one embodiment of the handle of the cleaning brush.

FIG. 7 shows an exploded view of one embodiment of the brush of the present disclosure. In certain embodiments, the detachable handle 12 and the brush portion 14 are removably attached to one another by interlocking connector pins 18*a*, 18*b*, 18*c*, and release pin 20 on the detachable handle 12, which are sized to fit into receptacles 22*a*, 22*b*, and 22*c* of the brush portion. A release actuator 16 is provided within channel 30 of the detachable handle 12. The release actuator 16 comprises a proximal surface 16*a* which may be engaged and pressed by the user to detach the handle from the brush portion. The release actuator further comprises a sloped surface 32 having two tabs 32*a* and 32*b* at the distal end of the release actuator. The sloped surface may comprise two rails running substantially parallel to each other with the release pin 20 fitting between the two rails.

The sloped surface 32 of the release actuator 16 engages a protrusion 20*a* on the release pin 20, such as a circumferential protrusion about the release pin 20, or one or more protrusions that extend from the sides of the release pin. In one embodiment, the release pin has two protrusions extending from opposing sides of the release pin. The release pin 20 further comprises a locking protrusion 34, which engages a release pin slot in the handle 44 to prevent the release pin from rotating on its axis. A biasing member 36, biases the release pin 20, in the engaged position within the receptacle 22*b*, thereby biasing the detachable handle in the attached position. In certain embodiments, the biasing member 36 is a coil spring. However, as should be understood by those of ordinary skill in the pertinent art, the biasing member can take the form of any type of spring, or alternatively, any biasing member, capable of biasing the release pin 20 into the receptacle 22*b*.

The release actuator 16 is manually movable within the channel 30 between a first rest position and a second clearance position. In the first rest position, the release pin 20 engages the sloped surface 32 of the release actuator 16 at the proximal end of the release actuator adjacent to the tabs 32*a* and 32*b*, and the biasing member 36 biases the release pin 20 into the receptacle 22*b* to hold the handle in place when attached to the brush portion. As the release actuator 16 is pressed into the channel 30 by the user, the release pin 20 moves along the sloped surface 32 of the release actuator 16, compressing the biasing member 36 and causing the release pin to recede into the release pin slot 44 in the detachable handle 12. In the second clearance position of the release actuator 16, the release pin 20 is substantially entirely contained within the release pin slot 44 such that the detachable handle 12 can be detached from the brush plate 14.

When the release actuator 16 is released, the biasing member 36 rebounds to move the release pin back to the rest position and thus the release actuator back to the first position. Accordingly, unless the release actuator 16 is manually moved into the second position, or the release pin 20 is moved into the clearance position, the release mechanism resides in the first position.

As shown in FIG. 3, the connector pins 18*a*, 18*b*, and 18*c* each comprise a post 45*a*, 45*b*, 45*c* extending from the backing plate 25 of the detachable handle 12 with at least one protrusion 46*a*, 46*b*, 46*c* at the distal end of the post opposite the backing plate. The protrusion is substantially perpendicular to the axis of the post. When the handle 12 is attached to the brush portion 14, the pins engage the receptacles 22*a*, 22*b*, and 22*c*. As the detachable handle 12 is being connected to the brush portion 14, the ejection pin 20 is depressed into the clearance position in the detachable handle 12 by the compressive force between the brush portion 14 and the biasing member 36 into a clearance position. When the connector pins are fully inserted within the receptacles, the handle is moved slightly forward, which aligns the release pin 20 with the receptacle 22*b*. The biasing member 36 returns the release pin 20 into its resting position within the cavity in the receptacle 22*b*. This causes the handle to become attached to the brush by engaging the protrusions 46*a*, 46*b*, 46*c* at the end of the posts 45*a*, 45*b*, 45*c* of the connector pins within the brush portion 14. The release pin 20 is engaged by the receptacle 22*b* thus restricting the freedom of motion of the handle and connector pins within the receptacles 22*a*, 22*b*, and 22*c* to lock the handle in place. When the release actuator is engaged, the release pin 20 recedes back into the clearance position thereby allowing the handle to be moved into a position freeing the motion of the connector pins and the handle with respect to the brush 14 and allowing the handle to be detached.

In certain embodiments, the posts of the connector pins 22*a*, 22*b*, and 22*c* are oriented substantially perpendicularly with the backing plate 24. In certain embodiments the shapes of the posts and protrusions are round, rectangular, or any other shape. In certain embodiments the shape of the ejection pin 20 is round, rectangular, or any other shape. As shown in FIG. 7, the connector pins may have protrusions 46*a*, 46*b*, 46*c* at the end of the posts 45*a*, 45*b*, 46*c*. The protrusions are fitted to the corresponding receptacles 22*a*, 22*b*, and 22*c* such that there is sufficient clearance between the connector pins and receptacles such that all the posts may be easily inserted into the receptacles. In certain embodiments, the cantilever portions are angled such that they may clear the walls of the receptacles, as shown for example on connector pin 18*c*. In certain embodiments, the positions, shapes, dimensions and number of connector pins and their clearances are chosen such that there is little relative motion between the handle 12 and the brush 14 while the handle and brush are attached and release pin 20 is in the resting position. In certain embodiments, the positions, shapes, dimensions, and number of connector pins are chosen to reduce stresses between the connector pins of the handle and the brush.

The present disclosure provides advantages over prior brushes by describing a brush capable of functioning as both a unitary hand held brush and a brush with a handle. The brush is easily attached and detached by pressing the release actuator and freeing the handle from the brush. When attached, the brush maintains a tight and rigid connection with the handle. The position of the button of the release actuator further decreases accidental engagement of the release actuator. However, when desired, the brush is easily released from the handle with a button press. Furthermore, the placement and shape of the pins are chosen such that forces expected to be exerted upon the brush handle and brush, such as torques and compressive forces are adequately resisted based on the design considerations, materials, and intended usage of the brush system.

As may be recognized by those of ordinary skill in the pertinent art based on the teachings herein, numerous changes and modifications can be made to the above-described and other embodiments of the present invention without departing from the scope of the invention as defined in the appended claims. Accordingly, this description of embodiments is to be taken in an illustrative, as opposed to a limiting sense.

What is claimed:

1. A cleaning brush, comprising:

a handle, wherein the handle comprises a gripping portion, a connector portion having a backing plate with means for connecting the handle to a brush, and means for releasing the handle to detach the handle from the brush; and a brush comprising a brush plate having means configured to receive the means for connecting and detaching the handle from the brush plate.

2. The cleaning brush of claim 1, wherein the brush plate comprises a rigid portion and a flexible portion with bristles attached to the rigid portion and bristles attached to the flexible portion.

3. The cleaning brush of claim 2, wherein the rigid portion comprises a solid member and the flexible portion comprises segments defined by channels in the flexible portion.

4. The cleaning brush of claim 3, wherein the rigid portion is constructed from a rigid plastic and the flexible portion is constructed from rubber.

* * * * *